United States Patent [19]

Rognsvoog, Jr.

[11] Patent Number: 4,700,835

[45] Date of Patent: Oct. 20, 1987

[54] ONE-PIECE THERMOFORMED DISPENSING PACKAGING

[76] Inventor: Albert J. Rognsvoog, Jr., 4135 Harvest La., Racine, Wis. 53402

[21] Appl. No.: 866,342

[22] Filed: May 23, 1986

[51] Int. Cl.[4] ..... B65D 85/671

[52] U.S. Cl. ..... 206/411; 206/389; 242/55.53; 242/1; 225/48; 225/50; 221/70

[58] Field of Search ..... 24/487, 543, 559, 587, 24/588; 206/389, 390, 411; 242/55.53, 75.4; 225/48, 50, 52, 41, 39, 46; 220/4 E, 339; 16/DIG. 3, 254, 255; 221/70

[56] References Cited

U.S. PATENT DOCUMENTS

| | | | |
|---|---|---|---|
| 3,102,671 | 9/1963 | Gershen | 225/48 X |
| 3,446,343 | 5/1969 | Zimmer et al. | 242/55.53 |
| 3,743,086 | 7/1973 | Aldrich | 206/411 X |
| 4,271,962 | 6/1981 | Stepanski | 206/411 |
| 4,279,359 | 7/1981 | Arnold | 221/70 |
| 4,286,729 | 9/1981 | Downing | 221/70 |
| 4,320,835 | 3/1982 | Polhemus et al. | 206/411 |

*Primary Examiner*—Stephen Marcus
*Assistant Examiner*—Michael Shea
*Attorney, Agent, or Firm*—Peter N. Jansson

[57] ABSTRACT

A thermoformed plastic package made of a single piece of formed plastic sheeting folded upon itself along a hinge band. The back and front sections form an enclosure, preferably for a tape roll, and have contacting portions which include flat areas and interlocked undercut mating areas which extend from a first position near the hinge around the enclosure to a second position near the hinge, and preferably along the hinge as well. The hinge band preferably includes a center portion narrower than the total width of two side portions therealong, and serves to draw the face-to-face sections of the package together along the hinge. A tape channel extending from the enclosure provides frictional engagement tape being dispensed.

19 Claims, 6 Drawing Figures

ONE-PIECE THERMOFORMED DISPENSING PACKAGING

FIELD OF THE INVENTION

This invention relates to thermoformed packaging and, more specifically, to one-piece thermoformed packages. Still more specifically, this invention relates to thermoformed tape-dispensing packages.

This invention is described herein primarily with reference to a particularly preferred specific embodiment—a one-piece thermoformed package used for dispensing tape segments useful as markers on magnetic tape. However, the invention has many other uses for dispensing packages and otherwise.

BACKGROUND OF THE INVENTION

Adhesive tapes of various types are supported on a carrier web and released from such web upon dispensing. An example is the markers used in the audio and video recording industries. Such marker tape segments may be one-inch strips of polyester film about 0.7 mils thick, having an aluminized coating and a layer of pressure-sensitive adhesive. Such segments may be supported end-to-end on a carrier web which is a strip of polyester film about 2 mils thick.

Dispensing packages for such tape include an enclosure for a tape roll and a tape exit channel extending from the enclosure to an opening at the edge of the package. At or near the end of the tape exit channel is a relatively sharp edge across the channel which serves as a means to allow the user to separate the tape segments from the carrier web.

Such relatively sharp edge allows separation of the tape segments from the carrier web without the need to pick the segments off by hand, in the well-known manner hereafter described. Avoiding hand and finger contact with the adhesive-bearing surface of the segments is considered important. It is well known that hand contact can contaminate the adhesive, and that such contamination is detrimental because the adhesive is used for securing the aluminized tape segments to the magnetic tape.

By running the carrier web (with segments thereon) over the edge, the carrier web bends sharply around the edge while the segments do not. This causes the segments to progressively separate from the carrier web. Such separation facilitates, again without the need to pick the segments off by hand, the accurate application of tape segments onto the magnetic tape on which they will serve as markers.

When the tape advance and segment separation has progressed to a point where about three-fourths of an individual segment has separated from the carrier web, the tape segment is positioned, without hand or finger contact, over the desired area of attachment, usually at a specific point on magnetic tape. The segment is then pressed into tight engagement with the magnetic tape by finger pressure. Thereafter, the remainder of that segment is withdrawn from the package and pressed into tight engagement with the magnetic tape.

In order to be able to use this application technique successfully, it is necessary that the carrier web and its attached tape segments be taut as they approach the edge around which they will be pulled. Thus, a significant restraining force must be applied to the tape in the package, either by finger pressure through the package or by the package itself.

If sufficient restraining force is not maintained during the dispensing step, the tape cannot be pulled tightly around the edge. Furthermore, the tape may advance too far during the tape withdrawal action—such that the front end of the tape segment following the one being dispensed will be too far out for later proper dispensing. At that point, the segment has to be manually removed from the carrier web, with all the attendant disadvantages of manual removal.

Efforts have been made in the prior art to develop packages for dispensing tape segments carried on a carrier web. In particular, dispensing packages have been developed which include means to restrain the dispensing of tape in order to improve the tape separation and application process described above.

Included in the prior art are U.S. Pat. No. 3,743,086 (Aldrich) and U.S. Pat. No. 4,279,359 (Arnold). These patents describe so-called "blister packs" that comprise a thermoformed plastic cover element having a surrounding flange that is heat sealed or otherwise adhered to a flat base member, typically a cardboard card.

The Aldrich package attempts to restrain the dispensing of tape by applying pressure to the tape as it moves through the exit channel. However, as recognized in the prior art, it is very difficult, at least with certain kinds of tapes, to obtain proper restraining force in this manner. The Arnold patent applies restraining force in a different manner—by providing a dentate hub which engages the inner diameter of the tape roll such that its rotation is restrained. This in turn restrains the dispensing of tape from the package.

The latter means for restraining tape dispensing functions better than the former. But when the tape has left the roll but is still inside the package, the absence of good restraining pressure on the tape makes proper dispensing difficult, particularly if the tape has advanced too far, as frequently is the case. Unless the tape can be rewound, the restraining force imposed by the tape roll hub within the package is lost.

Another problem with prior tape-dispensing packages is that the supposedly sharp edge around which the tape is pulled is not sharp after the packages has been used for a period of time. The card which provides the edge may become frayed or otherwise damaged such that a sharp edge is not available.

There are significant problems and deficiencies in the tape-dispensing packages of the prior art. There is a need for a tape-dispensing package having improved tape-restraint characteristics on tape which is off the roll but still within the package, that is, which more reliably imposes a restraining force on tape within its exit channel. There is a need for a tape-dispensing package which more easily allows rewinding such that tape segments need not be removed from the carrier web by hand. There is a need for a tape-dispensing package which may readily be opened and reclosed.

There is a need for a package which may be reopened and reclosed, yet still has a exit channel which imposes significant restraining force on the movement of tape within the channel. And, there is a need for a tape-dispensing package having a lasting edge which will allow effective tape-segment separation over the life of the package. More generally, there is a need for an improved thermoformed package which may be made from a single thermoformed sheet. There is a need for a simple reclosable package which may be reliably and tightly closed.

SUMMARY OF THE INVENTION

This invention is a thermoformed plastic package overcoming certain problems and deficiencies of the prior art, including those mentioned above. In a preferred embodiment, this invention is a thermoformed tape-dispensing package which is particularly useful for dispensing tape segments of the type dispensed with and from a web carrying such segments.

The thermoformed plastic package of this invention is a single piece of formed plastic sheeting folded back upon itself along a hinge band which divides the piece into back and front sections. The back and front sections have spaced portions, which together form an enclosure, and contacting portions. The back and front contacting portions include back and front main flat areas, respectively, and interlocked back and front mating areas which project from their respective main flat areas.

The mating areas have elongated interlocked undercut male and female configurations. Such mating areas extend from a first position which is near the hinge around the enclosure to a second position which is near the hinge and spaced from the first position, and preferably along all or a portion of the hinge band as well, closely spaced from such band. Such interlocked undercut configurations of the back and front sections of the single folded piece of formed plastic sheeting serve to hold the sections firmly together.

In highly preferred embodiments, the hinge band includes means to draw the back and front flat areas together. Portions of the back and front flat areas are on either side of the hinge band. To provide the advantage of drawing these flat areas firmly together, the hinge band includes a center portion and adjacent parallel side portions having certain relative dimensions.

The parallel side portions on either side of the center portion join the hinge band to the main flat areas of the back and front sections. The cross-dimension (width) of the center portion is less than the sum of the cross-dimensions of the side portions. With this configuration, the hinge band firmly draws the hinge-adjacent portions of the package together, which helps hold the back and front sections more firmly together.

In a preferred embodiment, the thermoformed plastic package forms a tape-dispensing package of the type having an enclosure for a tape roll and a tape exit channel extending from the enclosure to the edge of the package. The tape exit channel has opposite sidewalls formed by two parallel portions of the interlocked undercut back and front mating areas. Such parallel portions of the mating areas extend along the parallel edges of the tape being dispensed. The top and bottom walls of the tape exit channel are formed by portions of the back and front main flat areas which are between the parallel portions of mating areas.

The interlocked undercut male and female configurations in the mating portions forming the tape-dispensing channel sidewalls provide excellent restraining pressure on the tape being dispensed through the exit channel. Such restraining pressure is frictional pressure applied on the top and bottom surfaces of the tape-carrier web lamination within the channel. The hinge band configuration provides further firm contact by insuring that the mating portions remain fully engaged, particularly the portions extending along the hinge.

While significant tape-restraining force is applied within the tape-dispensing channel, as described above, important taperestraining force may also be applied by frictional engagement of a tape roll on a hub member, as described above. Such a hub may be formed either in the front section or in the back section of the single piece of thermoformed plastic sheeting, in known manner. And, the tape-dispensing package of this invention allows ready opening and reclosing such that the restraining force available from such hub may be recaptured for tape which was inadvertently pulled too far from the package.

The tape exit channel terminates in a plastic edge extending across the channel. Such plastic edge does not become deformed or frayed during tape dispensing. Such plastic edge reliably provides the sharp edge necessary for proper separation of tape segments from a carrier web passing over such edge.

OBJECTS OF THE INVENTION

It is an object of this invention to provide a thermoformed plastic package overcoming the problems and deficiencies in tape-dispensing packages of the prior art.

Another object of this invention is to provide a tape-dispensing package having improved tape-restraint characteristics.

Another object of this invention is to provide a tape-dispensing package with imposing improved restraint on tape which is off the roll but still within the package.

Another object of this invention is to provide a tape-dispensing package which more easily allows rewinding such that tape segments need not be removed from the carrier web by hand.

Another object of this invention is to provide a tape-dispensing package which may be reopened and reclosed, yet still has a exit channel which ir'poses significant restraining force on the movement of tape within the channel.

Yet another object of this invention is to provide a tape-dispensing package having a lasting edge which will allow effective tape-segment separation over the life of the package.

Still another object of this invention is to provide an improved thermoformed package made from a single sheet.

Another object of this invention is to provide a simple reclosable package which may be reliably and tightly closed.

These and other objects will be apparent from the following additional descriptions and from the drawings, wherein:

DETAILED DESCRIPTIONS OF PREFERRED EMBODIMENTS

Figure 1:
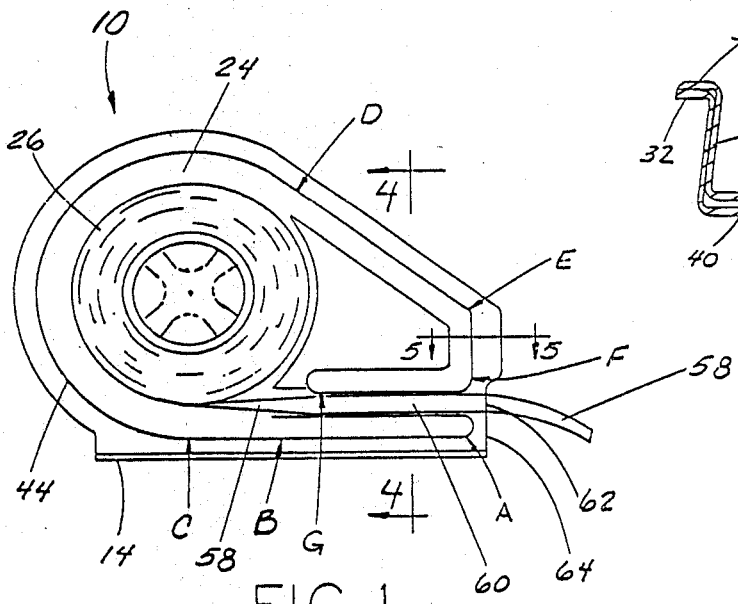
FIG. 1 is a plan view of a preferred thermoformed package for dispensing tape.

The figures illustrate a thermoformed plastic package 10 in accordance with this invention. Plastic package 10 is made of a single piece 12 of thermoformed plastic sheeting which is folded upon itself along a hinge band 14 dividing plastic piece 12 into a back section 16 and a front section 18. Back and front sections 16 and 18 are such that the profile of plastic piece 12, prior to folding, is substantially symmetrical around hinge band 14.

Back and front sections 16 and 18 include parallel spaced portions 20 and 22, respectively, which form an enclosure 24. Enclosure 24 may be used to hold a tape roll 26, which in the illustrated embodiment has a core frictionally engageable with a dentate hub 28 formed on spaced portion 20 of back section 16.

In addition to spaced portions 20 and 22, back and front sections 16 and 18 have contacting portions. Those overlying portions of back and front sections 16 and 18 which are in contact or near contact with each other are referred to herein as "contacting" portions.

The contacting portions of back and front sections 16 and 18 include back and front main flat areas 30 and 32, respectively, and back and front mating areas 34 and 36, respectively.

In the case of back section 16, back main flat area 30 is in the same plane as spaced portion 20 which defines enclosure 24. Back and front main flat areas 30 and 32 extend around the peripheries of back and front sections 16 and 18, respectively, including along the entire length of hinge band 14 on either side thereof. Back mating areas 34 and front mating areas 36 project from back main flat area and front main flat area, respectively.

Figure 2:
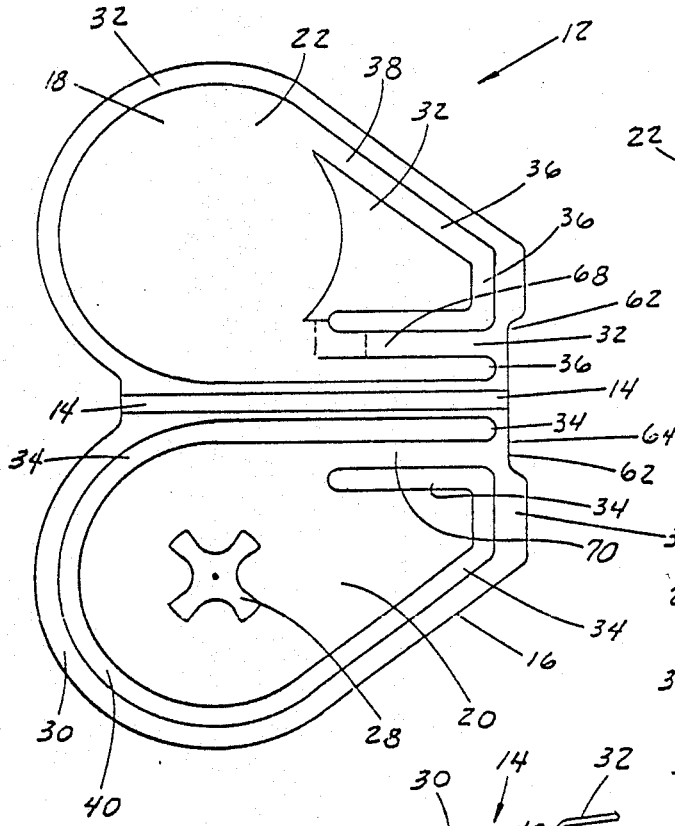
FIG. 2 is a plan view of a single thermoformed plastic piece used to form the package of FIG. 1.

FIG. 2 shows plastic piece 12 before it is folded upon itself along hinge band 14. What will become the outside surface of plastic package 10 is shown. The underside of piece 12, as shown in FIG. 2, includes the surfaces of back and front sections 16 and 18 which will contact each other upon folding. In such contact, back mating areas 34 and front mating areas 36 will be engaged to hold back and front sections 16 and 18 firmly together, in face-to-face engagement.

As viewed from the underside of FIG. 2, front mating areas 36 are female troughs 38 and back mating areas 34 are male ridges 40. Troughs 38 and ridges 40 are in corresponding positions on front and back sections 18 and 16, respectively, and, when single plastic piece 12 has been made into plastic package 10, as shown in FIGS. 1, 4, and 5, male ridges 40 engage female troughs 38 to hold the back and front sections 16 and 18 together.

Figure 5:
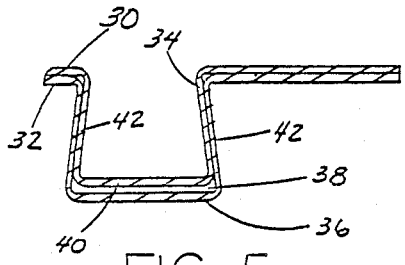
FIG. 5 is an enlarged sectional view taken along section 5—5, as indicated in FIG. 1.
Figure 4:
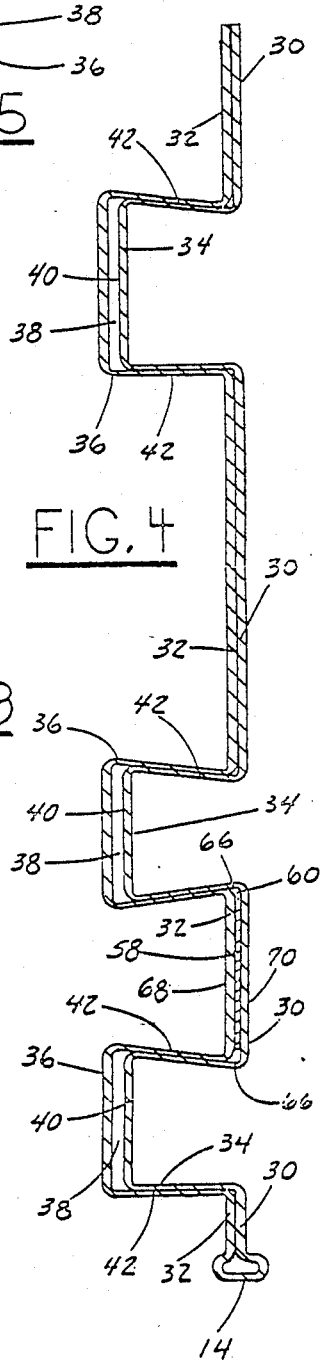
FIG. 4 is an enlarged sectional view taken along section 4—4, as indicated in FIG. 1.

As illustrated best in FIGS. 4 and 5, each of the female troughs 38 and each of the male ridges 40 have sidewalls 42. Sidewalls 42 of an engaged male ridge 40 and female trough 38 are in contact.

Female troughs 38 and male ridges 40 are of undercut configuration such that they can be effectively interlocked. That is, sidewalls 42 of female troughs 38 and male ridges 40, rather than being generally perpendicular to back and front main flat areas 30 and 32, are angled with respect thereto such that back and front mating areas 34 and 36 are interlocked in dovetail fashion.

A preferred angle of sidewalls 42 to main flat areas 30 and 32 is on the order of 7 degrees beyond perpendicular. However, the exact angling may be dependent on a number of factors, including the characteristics of the plastic material used.

The location of such undercut configurations can be described by reference to the figures. Referring primarily to FIG. 1, the interlocked mating areas 34 and 36 start from the point marked A and extend in order through points B, C, D, E and F to end at point G.

The cross-sectional undercut configurations of the interlocked mating area at different points are illustrated in FIGS. 4 and 5. The lower interlocked portion of FIG. 4 represents the cross-sectional configuration between points A and B. At that location, the pair of contacting sidewalls 42 of the interlocked trough 38 and male ridge 40 which is closest to hinge 14 is not undercut, while the pair of sidewalls away from hinge 14 is undercut.

From point B to point C, the adjoining sidewalls closest to hinge 14 continue in the same fashion as is illustrated at the bottom of FIG. 4, but there is no opposite adjoining sidewall portion because spaced portion 22 of front section 18 continues until it joins the lowermost sidewall. From point C around enclosure 24 to about point D there is only one pair of adjoining sidewalls for the mating areas, and such adjoining sidewalls, which are identified by numeral 44 in FIG. 1, have undercut configurations to hold the edges of back and front sections 16 and 18 firmly together.

The configuration of the interlocked mating areas 34 and 36 between points D and E is illustrated by the mating areas at the top of FIG. 4. The uppermost adjoining sidewalls are undercut while the opposite pair of adjoining sidewalls are not undercut. FIG. 5 illustrates that the interlocked mating areas between points E and F are undercut on both sides to give an extra firm locking in that area, which is the narrow end of plastic package 10. Likewise, the double undercut configuration continues between points F and G.

Thus, the mating areas have interlocked undercut male and female configurations extending around enclosure 24 from a first position (point C) all the way to second position (point G), both of which are near hinge band 14. Furthermore, the undercut mating areas extend along hinge 14, closely adjacent thereto, from point A to beyond point C. In the embodiment illustrated, only the portion of the mating areas between points B and C does not include undercut configurations. Such undercut configuration around enclosure 24 and along hinge 14 holds the back and front sections 16 and 18 firmly together.

The characteristics of hinge band 14 serve an important function in the unique combinations forming preferred embodiment of this invention. Such characteristics are illustrated best in FIGS. 4 and 6, and to some extent in FIG. 3. Hinge 14 includes means to draw back and front main flat areas 30 and 32 together, thus greatly improving the close face-to-face contact of back and front sections 16 and 18 and allowing such firm and close contact to continue over the life of thermoformed plastic package 10.

More specifically, hinge band 14 is made up of three integral parallel band portions which in turn are integral with main flat areas 30 and 32 of back and front sections 16 and 18 on either side of hinge band 14. As illustrated best in FIG. 6, such parallel hinge band portions include: elongated first side portion 46 which is integral with back main flat area 30 along the length of hinge 14; an elongated center portion 48 integrally formed with first side portion 46 and extending along the length of hinge 14; and an elongated second side portion 50 integrally formed with center portion 48 and extending along the length of hinge 14. First and second side portions 46 and 50 of hinge band 14 are along the opposite edges of elongated center portion 48. Second side portion 50 is integral with front main flat area 32 in the same manner as first side portion 46 is integral with back main flat area 30.

An important characteristic of hinge band 14 relates to the relative cross-dimensions of portions 46, 48 and 50 of hinge band 14. The cross-dimension of center portion 48, that is, the width of center portion 48 as measured in a direction across hinge band 14, is less than the combined cross-dimensions of first and second side portions 46 and 50. This characteristic allows center portion 48 to strongly draw back and front main flat areas 30 together.

Figure 6:
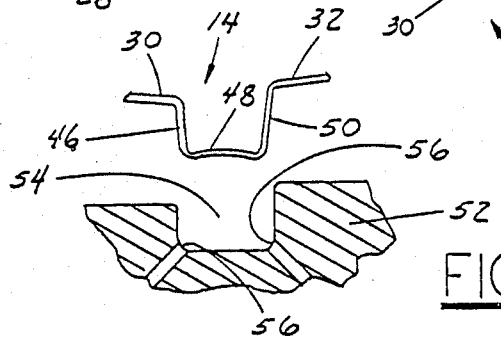
FIG. 6 is a further enlarged fragmentary sectional view, illustrating details of the hinge band of the package shown in the figures and a portion of the thermoforming mold used in producing it.

FIG. 6 also illustrates a small portion of a vacuum-forming mold used for forming plastic piece 12. More specifically, FIG. 6 illustrates that portion of thermoforming mold 52 which forms hinge band 14. Hinge band 14 is formed in elongated groove 54. Groove 54 includes a center portion and side portions corresponding to band portions 48, 46 and 50 of hinge band 14, previously described. Vacuum holes 56 are along the junctures of the center portion and side portions of groove 54 to facilitate the forming process using well-known vacuum-forming methods.

Figure 3:
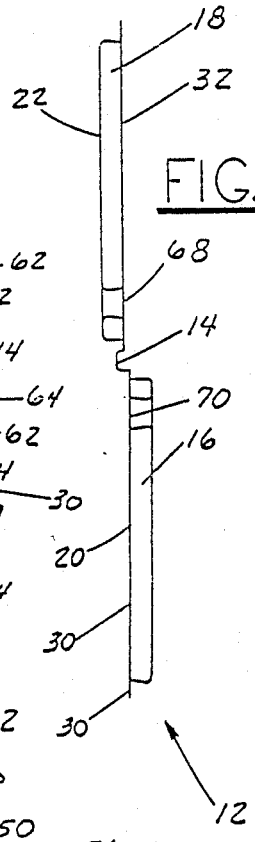
FIG. 3 is a right side view of FIG. 2.

FIGS. 3 and 6 illustrate hinge band 14 in a generally idealized form, that is, a form in which center portion 48 and first and second side portions 46 and 50, and their immediately adjacent main flat areas 30 and 32, are distinctly divided and generally at right angles from one portion to its adjacent portion or portions. However, when thermoforming is performed in rather small areas, such as may be required for hinge band 14, the mold-stripping procedure as well as dimensional changes which occur during cooling, particularly when very thin materials are used, will make the stripped product look somewhat different.

The various portions of hinge band 14 and the immediately adjacent portions of back and front sections 16 and 18 will most typically be somewhat different in appearance—with less distinct edges and a less easily recognizable shape. However, having been formed with the aforementioned dimensional requirements in the thermoforming process, hinge band 14 will provide the effect of drawing together back and front sections 16 and 18 along hinge band 14, and holding them in such secure position throughout the life of the package.

In a highly preferred form, the total width of hinge band 14, summing the widths of every portion thereof, is less than 0.400 inch for material which after forming has a thickness on the order of 0.005 inches. And, the cross-dimension of center portion 48 will be on the order of 40 percent of the sum of the cross-dimensions of side portions 46 and 50.

Considerable variations can be made in these dimensions and in the relative cross-dimensions while still providing the drawing together which is characteristic of such hinge. While FIGS. 3 and 5 illustrate a hinge band in which side portion 50 has a greater cross-dimension than side portion 46, the cross-dimension of the opposite side portions can be equal.

Single plastic piece 12 is preferably formed of an unplasticized industrial grade polyvinyl chloride, a generally transparent material. Acceptable unplasticized industrial grade polyvinyl chloride materials are available from American Hoechst, of Delaware City, Delaware, or Nanya Plastics, of Chicago, Illinois. A preferred thickness for the material prior to thermoforming is on the order of 0.018 inch, although considerable variation is possible. A wide variety of other thermoformable plastic sheet materials may be used for the plastic package of this invention.

The extent (angle) of the undercut configurations of the back and front mating areas can be increased or decreased and the undercut configuration can be extended to other areas across the package. For example, the lowermost adjoining sidewalls of the interlocked mating areas nearest hinge 14, as illustrated in FIG. 4, can be undercut as well as the opposed adjoining sidewalls of such mating areas. And, such undercut configuration could continue between points B and C as well.

As a general rule, the greater the extent of the undercut configuration, both in the angle and in the lengths of undercut areas involved, the firmer will be the interengagement of back and front sections 16 and 18. However, the greater the extent of the undercut configurations, the more difficult it will be to strip the thermoformed single plastic piece 12 from the thermoforming mold. Difficulty in mold stripping not only slows down production but may cause damage to the plastic piece unless complex and expensive molds are used.

Thus, the design of packages with firmly interlocked back and front sections which can be quickly manufactured without difficulty requires a degree of compromise. Using the principles of this invention, however, an excellent one-piece thermoformed plastic package with firm interlocking characteristics can easily be mass-produced.

A highly preferred embodiment of this invention, as indicated above, is a tape-dispensing package of the type having an enclosure for a tape roll and a tape exit channel extending from the enclosure. Thermoplastic package 10 is such a package.

Tape 58, illustrated in FIGS. 1 and 4, may be pulled from tape roll 26, and at its tangent point of departure from roll 26 begins a 90-degree twist such that it enters and passes through a tape exit channel 60. Tape exit channel 60 starts within plastic package 10 at enclosure 24 and terminates in an edge 62 across channel 60 at the narrow end 64 of package 10.

Tape channel 60 has sidewalls 66 which are formed by two parallel portions of the interlocked mating areas—namely, the hinge-adjacent portion extending between points A and B, which is closely adjacent to hinge band 14, and the portion extending between points F and G, which is spaced from the hinge-adjacent portion. Tape channel 60 also has top and bottom walls 68 and 70, which are formed by the portions of front and back main flat areas 32 and 30 which are between interlocked mating areas A-B and F-G.

The aforementioned undercut configurations of interlocked mating areas A-B and F-G, as well as the aforementioned action of hinge 14, cause top wall 68 and bottom wall 70 to frictionally engage tape 58 within tape exit channel 60. Such frictional engagement helps to control the manner in which tape 58 is dispensed from package 10.

Such tape-dispensing control is very important when the tape is of the type (not shown) having segments on a carrier web from they must be released as they bend over a relatively sharp edge, such as edge 62 at the end of tape exit channel 60. The package of this invention provides such tape dispensing and separation in a highly advantageous way. Furthermore, unlike prior packages for dispensing tape of this type, thermoformed plastic package 10 may readily be opened and reclosed, as may be helpful when too much tape has been pulled from package 10 and rewinding is desired.

While the principles of this invention have been described in connection with specific embodiments, it should be understood clearly that these descriptions are made only by way of example and are not intended to limit the scope of the invention.

What is claimed is:

1. In a thermoformed plastic package, the improvement comprising:

a single piece of formed plastic sheeting folded upon itself along a hinge dividing the piece into back and front sections;

the back and front sections having (a) spaced portions forming an enclosure, and (b) contacting portions including back and front main flat areas, respectively, and interlocked back and front mating areas projecting from their respective main flat areas; and the mating areas having interlocked undercut male and female configurations extending from a first position near the hinge around the enclosure to a second position near the hinge and spaced from the first position;

whereby the sections are firmly held together.

2. The package of claim 1 wherein the hinge includes means to draw the back and front flat areas together.

3. The package of claim 2 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

4. The package of claim 1 wherein the mating areas extend along the hinge.

5. The package of claim 4 wherein the hinge includes means to draw the back and front flat areas together.

6. The package of claim 5 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

7. In a tape-dispensing package of the type having an enclosure for a tape roll and a tape exit channel extending from the enclosure, the improvement comprising:

a single piece of formed plastic sheeting folded upon itself along a hinge dividing the piece into back and front sections;

the back and front sections having (1) spaced portions forming the enclosure, and (2) contacting portions including back and front main flat areas, respectively, and back and front mating areas projecting from their respective main flat areas; and the channel having opposite sidewalls formed by two parallel portions of the mating areas and top and bottom walls formed by portions of the back and front main flat areas, said parallel portions of the mating areas having interlocked undercut male and female configurations, whereby tape within the channel is frictionally engaged by the top and bottom walls.

8. The package of claim 7 wherein the hinge includes means to draw the back and front flat areas together.

9. The package of claim 8 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

10. The package of claim 7 further including an edge across the channel near the end of the tape exit channel, whereby tape exiting the channel can be bent sharply therearound.

11. The package of claim 10 wherein one of the spaced portions includes a hub member sized to frictionally engage the tape roll.

12. The package of claim 11 wherein the hinge includes means to draw the back and front flat areas together.

13. The package of claim 12 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

14. In a dispensing package of the type having an enclosure for a material to be dispensed and an exit channel extending from the enclosure to an exit, the improvement comprising:

a single piece of formed plastic sheeting folded upon itself along a hinge dividing the piece into back and front sections;

the back and front sections having (a) spaced portions forming the enclosure, and (b) contacting portions including back and front main flat areas, respectively, and back and front mating areas projecting from their respective main flat areas;

the channel having top and bottom walls formed by portions of the back and front main flat areas;

the mating portions having interlocked undercut male and female configurations extending from a first position near the hinge around the enclosure to a second position near the hinge; and the hinge including means to draw the back and front flat areas together, whereby the sections are firmly held together and material within the channel is frictionally engaged by the top and bottom walls.

15. The package of claim 14 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

16. The package of claim 14 wherein additional mating areas extend along the channel, said additional mating areas having interlocked undercut male and female configurations.

17. The package of claim 14 wherein the mating areas extend along the hinge.

18. The package of claim 17 wherein the hinge comprises a band having a center portion and parallel side portions on either side of the center portion, each of said side portions joining the center portion to the main flat area of one of the back and front sections, the cross-dimension of the center portion being less than the sum of the cross-dimensions of the side portions.

19. The package of claim 18 wherein additional mating areas extend along the channel, said additional mating areas having interlocked undercut male and female configurations.

* * * * *